US007019665B2

(12) United States Patent
Hall et al.

(10) Patent No.: US 7,019,665 B2
(45) Date of Patent: Mar. 28, 2006

(54) POLISHED DOWNHOLE TRANSDUCER HAVING IMPROVED SIGNAL COUPLING

(75) Inventors: David R. Hall, Provo, UT (US); Joe Fox, Spanish Fork, UT (US)

(73) Assignee: IntelliServ, Inc., Provo, UT (US)

( * ) Notice: Subject to any disclaimer, the term of this patent is extended or adjusted under 35 U.S.C. 154(b) by 430 days.

(21) Appl. No.: 10/653,564

(22) Filed: Sep. 2, 2003

(65) Prior Publication Data

US 2005/0046590 A1 Mar. 3, 2005

(51) Int. Cl.
*G01V 3/00* (2006.01)

(52) U.S. Cl. ..... 340/854.4; 340/854.8; 367/82; 336/132

(58) Field of Classification Search ..... 340/854.8, 340/854.4; 166/65.1; 336/132, 90; 367/82; 174/75 C; 439/194, 296, 13
See application file for complete search history.

(56) References Cited

U.S. PATENT DOCUMENTS

| | | | | |
|---|---|---|---|---|
| 4,496,203 | A * | 1/1985 | Meadows | 439/194 |
| 6,392,317 | B1 * | 5/2002 | Hall et al. | 307/90 |
| 6,670,880 | B1 * | 12/2003 | Hall et al. | 336/132 |
| 6,717,501 | B1 * | 4/2004 | Hall et al. | 336/132 |
| 6,830,467 | B1 * | 12/2004 | Hall et al. | 439/194 |
| 6,844,498 | B1 * | 1/2005 | Hall et al. | 174/75 C |
| 6,888,473 | B1 * | 5/2005 | Hall et al. | 340/854.4 |
| 2004/0164838 | A1 * | 8/2004 | Hall et al. | 336/234 |
| 2004/0246142 | A1 * | 12/2004 | Hall et al. | 340/854.9 |
| 2005/0001738 | A1 * | 1/2005 | Hall et al. | 340/854.8 |
| 2005/0074988 | A1 * | 4/2005 | Hall et al. | 439/13 |
| 2005/0285705 | A1 * | 12/2005 | Hall et al. | 336/132 |
| 2005/0285752 | A1 * | 12/2005 | Hall et al. | 340/854.8 |

FOREIGN PATENT DOCUMENTS

| | | |
|---|---|---|
| EP | 0399987 A1 | 11/1990 |
| WO | W8801096 | 2/1988 |
| WO | WO9014497 | 11/1990 |

* cited by examiner

*Primary Examiner*—Albert K. Wong
(74) *Attorney, Agent, or Firm*—Jeffery E. Daly

(57) ABSTRACT

Apparatus and methods to improve signal coupling in downhole inductive transmission elements to reduce the dispersion of magnetic energy at the tool joints and to provide consistent impedance and contact between transmission elements located along the drill string. A transmission element for transmitting information between downhole tools is disclosed in one embodiment of the invention as including an annular core constructed of a magnetically conductive material. The annular core forms an open channel around its circumference and is configured to form a closed channel by mating with a corresponding annular core along an annular mating surface. The mating surface is polished to provide improved magnetic coupling with the corresponding annular core. An annular conductor is disposed within the open channel.

20 Claims, 8 Drawing Sheets

POLISHED DOWNHOLE TRANSDUCER HAVING IMPROVED SIGNAL COUPLING

This invention was made with government support under Contract No. DE-FC26-97FT343656 awarded by the U.S. Department of Energy. The government has certain rights in the invention.

BACKGROUND OF THE INVENTION

1. Field of the Invention

This invention relates to oil and gas drilling, and more particularly to apparatus and methods for reliably transmitting information between downhole drilling components.

2. Background

Apparatus and methods are needed to effectively transmit data along downhole-drilling strings in order to transmit data from downhole components, such as tools located at or near a drilling bottom hole assembly, to the earth's surface for analysis. Nevertheless, the design of a reliable downhole transmission system is difficult due to numerous design constraints. For example, drill strings may include hundreds of sections of drill pipe and other downhole tools connected together. Data must be transmitted reliably across each tool joint to provide a continuous path between downhole tools and the surface.

Reliably transmitting data across tool joints is difficult for several reasons. First, since the tool joints are typically screwed together, each of the tools may rotate with respect to one another. In addition, as the tool joints are threaded together and primary and secondary shoulders of the drilling tools come together, the axial alignment of tools may be inconsistent. Contacts or other types of transmission elements located at the tool joint need to provide reliable connectivity despite the relative rotation and inconsistent axial alignment of downhole tools.

Moreover, the treatment and handling of drill string components may be quite harsh. For example, as sections of drill pipe or other tools are connected together before being sent downhole, ends of the drill pipe may strike or contact other objects. Thus, comparatively delicate transmission elements located at the tool ends can be easily damaged. In addition, substances such as drilling fluids, mud, sand, dirt, rocks, lubricants, or other substances may be present at or between the tool joints. This may degrade data connections at the tools joints. Moreover, the transmission elements may be subjected to these conditions each time downhole tools are connected and disconnected. Inconsistent tolerances of downhole tools may also cause signal degradation as signals travel up and down the drill string.

Inductive transmission elements provide one solution for transmitting data between downhole tools. An inductive transmission element functions by converting electrical signals to magnetic fields for transmission across the tool joint. A corresponding inductive transmission element located on the next downhole tool converts the magnetic field back to an electrical signal where it may be transmitted along the drill string.

In selected embodiments, an inductive transmission element may include a conductor to carry an electrical current and a magnetically conductive, electrically insulating material surrounding the conductor to provide a magnetic path for the magnetic field emanated from the conductor. The magnetically conductive, electrically insulating material may reduce signal loss associated with dispersion of the magnetic field.

In certain embodiments, an inductive transmission element has an annular shape. The inductive transmission element is inserted into an annular recess formed in the secondary shoulder of the pin end or box end of a downhole tool. The annular shape allows the inductive transmission element to always be oriented correctly with respect to a corresponding inductive transmission element with which it communicates. The placement of the inductive transmission element on the secondary shoulder allows the element to be protected within the downhole tool, and reduces stress that would otherwise exist on the element if located on the primary shoulder.

The use of inductive transmission elements at tool joints may provide several advantages compared to the use of transmission elements using direct electrical contacts. For example, inductive transmission elements may provide more reliable contact than direct electrical contacts. An inductive transmission element may not require direct contact with another element, whereas the electrical contact would always require direct contact. In addition, electrical contacts may cause arcing that might ignite substances present downhole such as flammable liquids or gases.

Since a drill string may extend into the earth 20,000 feet or more, it is possible that a signal may pass through hundreds of inductive transmission elements as the signal travels up or down the drill string. The failure of a single inductive transmission element may break the transmission path between the bottom hole assembly and the surface. Thus, the inductive transmission element must be robust, provide reliable connectivity, and provide efficient signal coupling. Because signal loss may occur at each tool joint, apparatus and methods are needed to reduce signal loss as much as possible to reduce the need for frequent signal repeaters along the drill string.

Thus, what are needed are apparatus and methods to improve signal coupling in downhole inductive transmission elements.

What are further needed are apparatus and methods to reduce the dispersion of magnetic energy at the tool joints.

What are further needed are apparatus and methods to provide consistent impedance and contact between transmission elements located along the drill string.

SUMMARY OF THE INVENTION

In view of the foregoing, it is a primary object of the present invention to provide apparatus and methods to improve signal coupling in downhole inductive couplers. It is a further object of the invention to provide apparatus and methods to reduce the dispersion of magnetic energy at the tool joints. It is yet another object of the invention to improve current apparatus and methods by providing consistent impedance and contact between transmission elements located along the drill string Consistent with the foregoing objects, and in accordance with the invention as embodied and broadly described herein, a transmission element for transmitting information between downhole tools is disclosed in one embodiment of the invention as including an annular core constructed of a magnetically-conductive material. The annular core forms an open channel around its circumference and is configured to form a closed channel by mating with a corresponding annular core along an annular mating surface. The mating surface is polished to provide improved magnetic coupling with the corresponding annular core. An annular conductor is disposed within the open channel.

In selected embodiments, grinding, lapping, hand polishing, annealing, sintering, direct firing, wet etching, dry etching, or a combination thereof, is used to polish the mating surface. In other embodiments, the mating surface is polished in multiple stages. In certain embodiments, the mating surface is treated to minimize the alteration of magnetic properties of the annular core.

In selected embodiments, a transmission element in accordance with the invention includes a biasing member configured to urge the annular core toward a corresponding annular core. The biasing member may be a spring, an elastomeric material, an elastomeric-like material, a sponge, a sponge-like material, or a combination thereof.

In certain embodiments, the annular core provides a low reluctance path for magnetic flux emanated from the annular conductor. The mating surface of the annular core may be polished to reduce the dispersion of magnetic flux passing from one mating surface to another. In selected embodiments, the magnetically conductive material is a ferrite. In other embodiments, the annular conductor comprises multiple coiled conductive strands. In yet other embodiments, the open channel of the annular core has a substantially U-shaped cross-section.

In another aspect of the invention, a method for improving signal transmission between transmission elements includes providing an annular core constructed of a magnetically conductive material. The annular core forms an open channel around its circumference and is configured to mate with a corresponding annular core along an annular mating surface, in order to form a closed channel. The method further includes polishing the mating surface to improve magnetic coupling with the corresponding annular core and placing an annular conductor in the open channel.

In selected embodiments, polishing may include a technique such as grinding, lapping, hand polishing, annealing, sintering, direct firing, wet etching, dry etching, or a combination thereof. Polishing may also include polishing the mating surface in multiple stages. In certain embodiments, a method in accordance with the invention may include treating the mating surface to minimize the alteration of magnetic properties of the annular core.

In selected embodiments, the method may include urging the annular core toward a corresponding annular core. Urging may be accomplished with a biasing member to urge the annular core toward a corresponding annular core. The biasing member may be a spring, an elastomeric material, an elastomeric-like material, a sponge, a sponge-like material, or a combination thereof.

In selected embodiments, the annular core provides a low reluctance path for magnetic flux emanated from the annular conductor. In addition, polishing of the annular core may reduce the dispersion of magnetic flux passing from one mating surface to another. In certain embodiments, the magnetically conductive material used to construct the annular core is a ferrite.

BRIEF DESCRIPTION OF THE DRAWINGS

The foregoing and other features of the present invention will become more fully apparent from the following description, taken in conjunction with the accompanying drawings. Understanding that these drawings depict only typical embodiments in accordance with the invention and are, therefore, not to be considered limiting of its scope, the invention will be described with additional specificity and detail through use of the accompanying drawings in which.

DETAILED DESCRIPTION OF THE INVENTION

It will be readily understood that the components of the present invention, as generally described and illustrated in the Figures herein, could be arranged and designed in a wide variety of different configurations. Thus, the following more detailed description of embodiments of apparatus and methods of the present invention, as represented in the Figures, is not intended to limit the scope of the invention, as claimed, but is merely representative of various selected embodiments of the invention.

The illustrated embodiments of the invention will be best understood by reference to the drawings, wherein like parts are designated by like numerals throughout. Those of ordinary skill in the art will, of course, appreciate that various modifications to the apparatus and methods described herein may easily be made without departing from the essential characteristics of the invention, as described in connection with the Figures. Thus, the following description of the Figures is intended only by way of example, and simply illustrates certain selected embodiments consistent with the invention as claimed herein.

Figure 1:
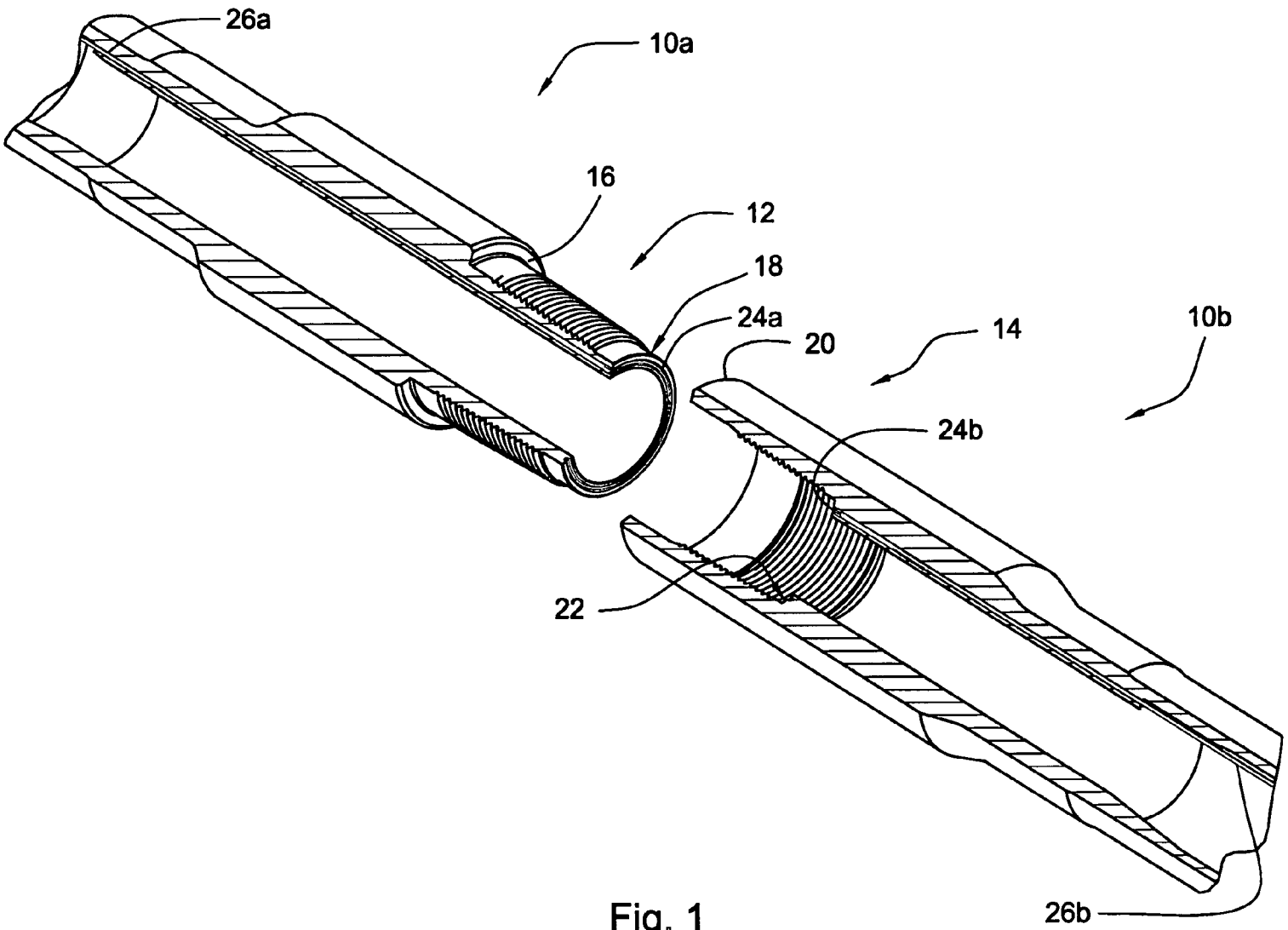
FIG. 1 is a cross-sectional perspective view of one embodiment of inductive transmission elements installed or integrated into downhole tools.

Referring to FIG. 1, in order to connect sections of drill pipe 10*a*, 10*b* and other downhole tools 10*a*, 10*b* together in series, each typically includes a pin end 12 and a box end 14. The pin end 12 usually has external threads that thread into internal threads of the box end 14. When connecting a pin end 12 to a corresponding box end 14, various shoulders of the tools 10*a*, 10*b* meet to provide additional structural support to the tools 10*a*, 10*b*.

For example, in selected downhole tools 10, the pin end 12 includes a primary shoulder 16 and a secondary shoulder 18. Likewise, the box end 14 includes a corresponding primary and secondary shoulder 20, 22. A primary shoulder 16, 20 is labeled as such to indicate that it provides the majority of the additional structural support to the drill pipe 10 or downhole component 10. Nevertheless, the secondary shoulder 18 may also provide significant support to the component 10.

In order to effectively monitor and control tools and sensors that are located downhole, apparatus and methods are needed to transmit information along the drill string. In order to achieve this objective, reliable apparatus and methods are needed to transmit information across tool joints where a pin end 12 connects to a box end 14.

In selected embodiments in accordance with the invention, a transmission element 24 is used to transmit data across a tool joint. For example, the transmission element 24*a* may be installed in the secondary shoulder of the pin end 12. This transmission element 24*a* is configured to transmit data to a corresponding transmission element 24*b* installed in the secondary shoulder 22 of the box end 14. Cables 27*a*, 27*b* or other transmission media 27 are connected to the transmission elements 24*a*, 24*b* to transmit data along the tools 10*a*, 10*b*.

In certain embodiments, a recess is provided in the secondary shoulder 18 of the pin end 12 and in the secondary shoulder 22 of the box end 14 to accommodate each of the transmission elements 24*a*, 24*b*. The transmission elements 24*a*, 24*b* may be constructed in an annular shape to circumscribe the radius of the drill pipe 10. Since the secondary shoulder 18 of the pin end 12 may contact the secondary shoulder 22 of the box end 14, the transmission element 24*a* may sit substantially flush with the secondary shoulder 18 of the pin end 12. Likewise, the transmission element 24*b* may sit substantially flush with the surface of the secondary shoulder 22 of the box end 14.

In selected embodiments, the transmission element 24*a* converts an electrical signal to a magnetic flux or magnetic field. This magnetic field is detected by the corresponding transmission element 24*b*. The magnetic field induces an electrical current in the transmission element 24*b*. This electrical current is then transmitted from the transmission element 24*b* to the electrical cable 27*b*.

As was previously stated, downhole-drilling environments may adversely affect communication between transmission elements 24*a*, 24*b* located on successive drill string components 10. For example, materials such as dirt, mud, rocks, lubricants, or other fluids, may inadvertently interfere with the contact or communication between transmission elements 24*a*, 24*b*. In other embodiments, gaps present between a secondary shoulder 18 on a pin end 12 and a secondary shoulder 22 on a box end 14 may interfere with communication between transmission elements 24*a*, 24*b*. Thus, apparatus and methods are needed to reliably overcome these as well as other obstacles.

Figure 2:
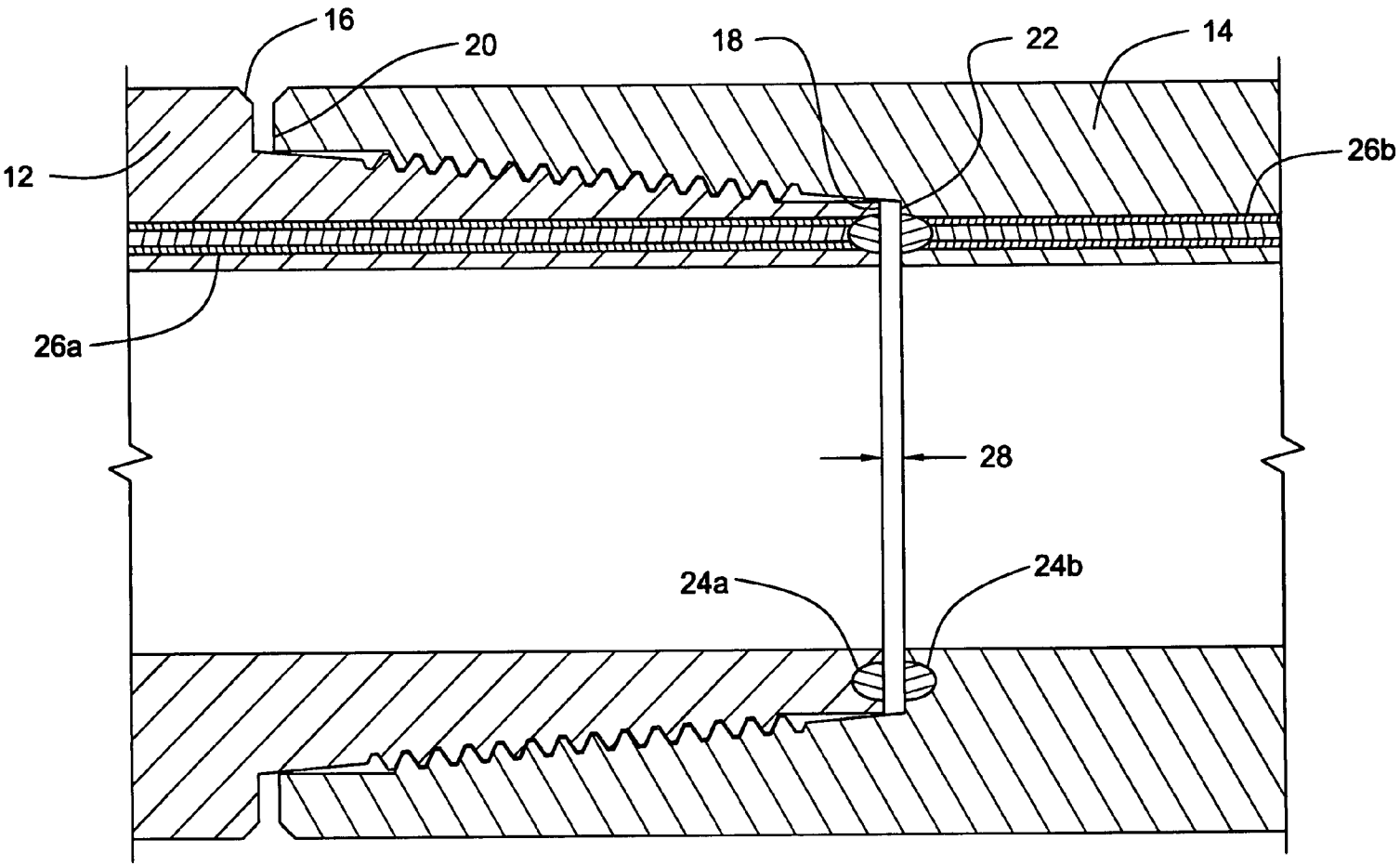
FIG. 2 is a cross-sectional view illustrating the relationship of inductive transmission elements communicating at the tool joint.

Referring to FIG. 2, for example, as was previously stated, a gap 28 may be present between the secondary shoulders 18, 22 of the pin end 12 and box end 14. This gap 28 may be the result of variations that are present in sections 10*a*, 10*b* of pipe. In other embodiments, the gap 28 may be the result of materials such as dirt, rocks, mud, lubricants, fluids, or the like, becoming interposed between the shoulders 18, 22.

In some cases, the transmission elements 24*a*, 24*b* may be designed such that optimal function occurs when the transmission elements 24*a*, 24*b* are in direct contact with one another. Thus, conditions that produce a gap 28 may cause malfunction of the transmission elements 24*a*, 24*b*, thereby impeding or interfering with the flow of data. Thus, apparatus and methods are needed to improve the reliability of transmission elements 24*a*, 24*b* even in the presence of gaps 28 or other interfering substances.

In certain embodiments, a transmission element 24*a*, 24*b* may be moveable with respect to a shoulder 18, 22 into which it is installed. Thus, the transmission elements 24*a*, 24*b* may be translated such that they are in closer proximity to one another. This may improve communication therebetween. In selected embodiments, the transmission elements 24*a*, 24*b* may be designed such that direct contact therebetween provides optimal communication.

In other embodiments, some limited separation between transmission elements 24*a*, 24*b* may still provide effective communication. As illustrated, the transmission elements 24*a*, 24*b* are mounted in the secondary shoulders 18, 22 of the pin end 12 and box end 14, respectively. In other embodiments, the transmission elements 24*a*, 24*b* may be installed in any suitable surface of the pin end 12 and box end 14, such as in primary shoulders 16, 20.

Figure 3:
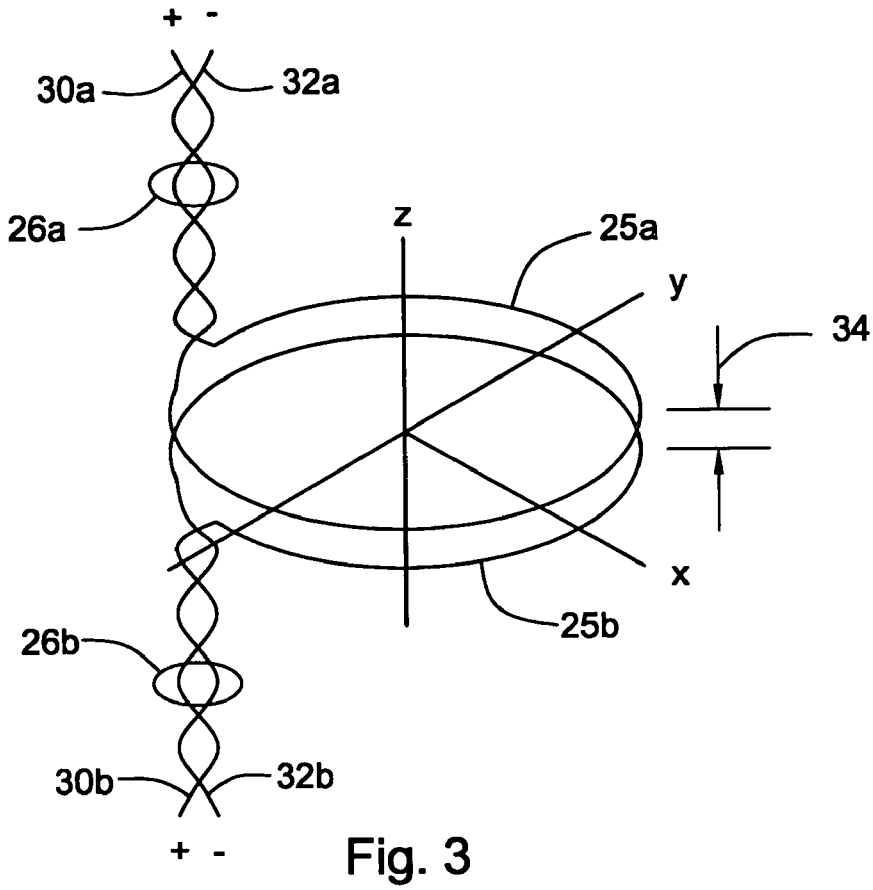
FIG. 3 is a schematic perspective view illustrating the theory of operation of inductive transmission elements in accordance with the invention.

Referring to FIG. 3, the function of the transmission elements 24*a*, 24*b* may be illustrated by a first conductive loop 25*a*, and a second conductive loop 25*b*. The loops 25*a*, 25*b* may be connected to a positive terminal 30*a*, 30*b* and a negative terminal 32*a*, 32*b*, respectively. When a voltage is applied across the terminals 30*a*, 32*a*, a current is induced in the loop 25*a*. This current may produce a magnetic field around the conductor forming the loop 25*a* in accordance with the laws of electromagnetism. The magnetic field produced by the loop 25*a* may induce an electrical current in a second loop 25*b*, thereby creating a voltage across the terminals 30*b*, 32*b*. Thus, an electrical signal transmitted along the terminals 30*a*, 32*a* may be reproduced on the terminals 30*b*, 32*b*.

Although an electrical signal may be successfully reproduced, the signal may lose a significant amount of power when it is transmitted from one loop 25*a* to another 25*b*. One parameter that may affect the amount of power that is lost is the distance 34 between the loops. In certain instances, closing the gap 34 may significantly reduce loss.

Figure 4:
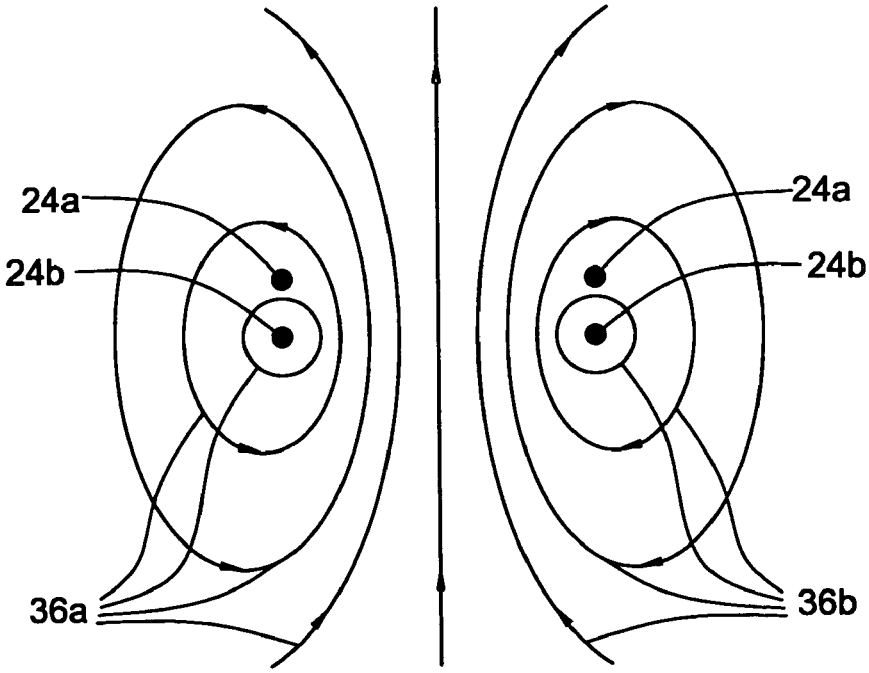
FIG. 4 is a schematic cross-sectional view illustrating the magnetic field present around a conductive coil carrying a changing electrical current.

Referring to FIG. 4, a cross-sectional view of the loops 25*a*, 25*b* is illustrated. As shown, a first current carrying loop 25*b* may produce a magnetic field around the conductor 25*b* as illustrated by magnetic field lines 36*a*, 36*b*. A second loop 25*a* may be positioned such that selected magnetic field lines 36*a*, 36*b* enclose the loop 25*a*, while others do not. Those field lines 36 that enclose the loop 25*a* may be effective to induce a current in the loop 25*a*, while those that do not enclose the conductor do not induce a current and thus may be associated with signal loss. Thus, in this example, the closer the loops are placed, the better the signal coupling between the loops 25*a*, 25*b*.

Figure 5:
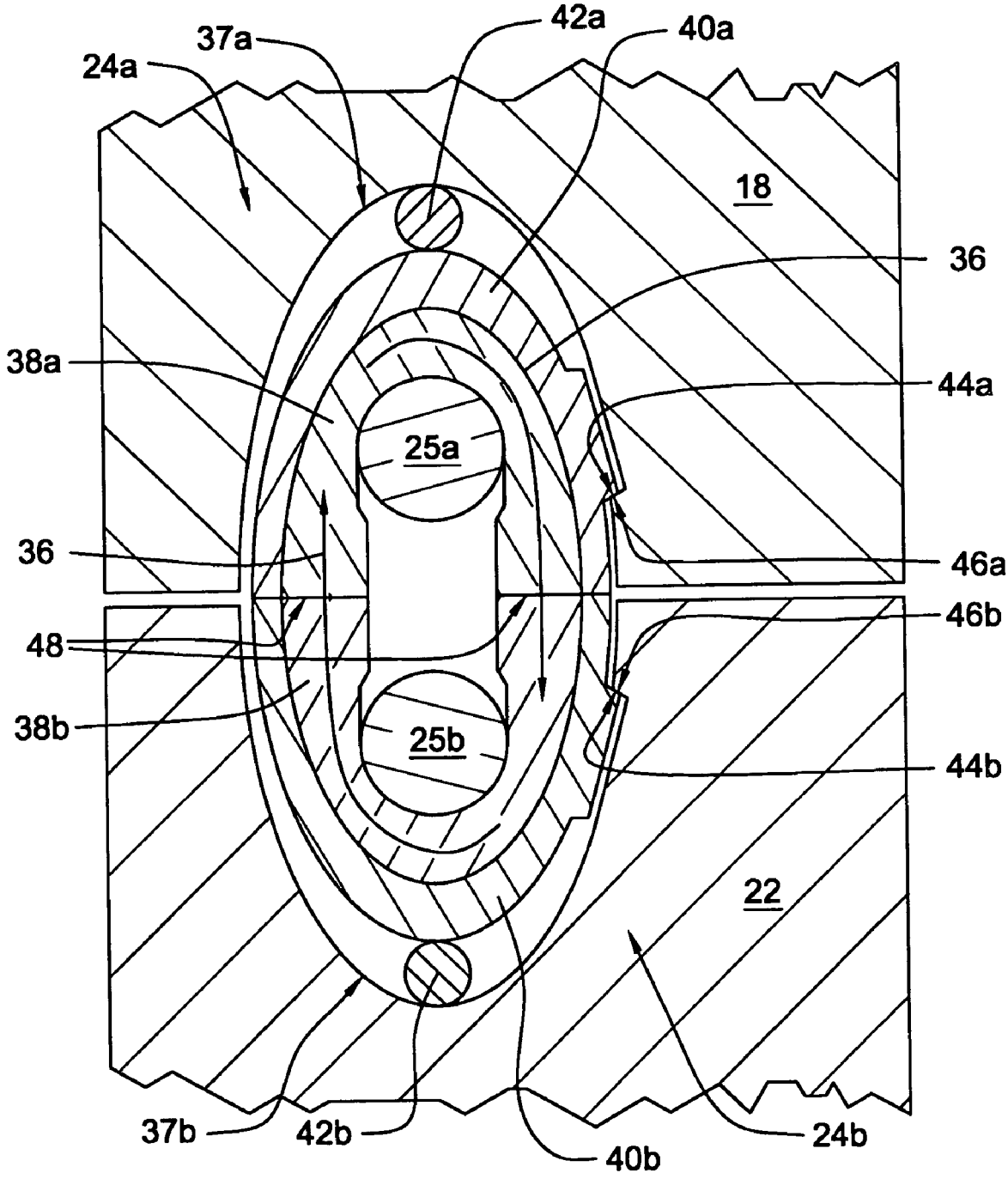
FIG. 5 is a cross-sectional view illustrating one embodiment of transmission elements in accordance with the invention forming a closed magnetic path.

Referring to FIG. 5, a cross-sectional view of one embodiment of transmission elements 24*a*, 24*b* is illustrated. In selected embodiments, transmission elements 24*a*, 24*b* in accordance with the invention may include conductive loops 25*a*, 25*b* surrounded by magnetically conductive cores 38*a*, 38*b*. The magnetically conductive cores 38*a*, 38*b* may be inserted into housings 40*a*, 40*b*. These housings 40*a*, 40*b* may sit within recesses 37*a*, 37*b* formed in secondary shoulders 18, 22.

In selected embodiments, biasing members 42*a*, 42*b* may be inserted between the housings 40*a*, 40*b* and the recesses 37*a*, 37*b* to urge the transmission elements 24*a*, 24*b* together. In selected embodiments, the housings 40*a*, 40*b* may be formed to include shoulders 44*a*, 44*b* that may interlock with corresponding shoulders 46*a*, 46*b*, formed in the recesses 37*a*, 37*b*. This may prevent the transmission elements 24*a*, 24*b* from exiting the recesses 37*a*, 37*b* completely.

The magnetically conductive cores 38*a*, 38*b* may be used to provide a magnetic path for the magnetic field emanating from the conductors 25*a*, 25*b*. When a gap exists between the two cores 38*a*, 38*b*, the magnetic path is open and magnetic energy may be lost at the gap. When the cores 38*a*, 38*b* come together, they formed a closed path in which the magnetic flux 36 may travel. The better the junction between the cores 38*a*, 38*b*, the lower the energy loss. In certain embodiments in accordance with the invention, the interface surfaces 48 between the cores 38*a*, 38*b* may be polished to provide improved contact therebetween, and to reduce the loss of magnetic energy.

The cores 38*a*, 38*b* may be constructed of any suitable material having desired electrical and magnetic properties. For example, in selected embodiments various "ferrites" may be suitable for use in the present invention. These materials may provide desired magnetic permeability, while being electrically insulating to prevent shorting of electrical current carried by the conductors 25*a*, 25*b*.

Figure 6:
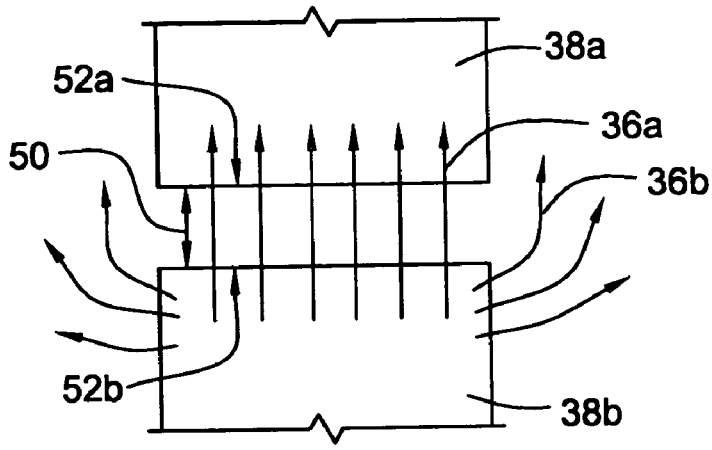
FIG. 6 is a cross-sectional view illustrating the transfer of magnetic energy from one annular core to another when a gap is present.

Referring to FIG. 6, when a gap 50 is present between mating surfaces of the cores 38*a*, 38*b*, significant magnetic energy may be lost at the gap 50 as magnetic fringe patterns 36*b* attempt to span the gap. As illustrated, selected magnetic field lines 36*a* may span the gap 50, while others 36*b* may be dispersed, resulting in signal loss. Thus, reducing the gap 50 as much as possible may improve signal coupling between the cores 38*a*, 38*b*.

Figure 7:
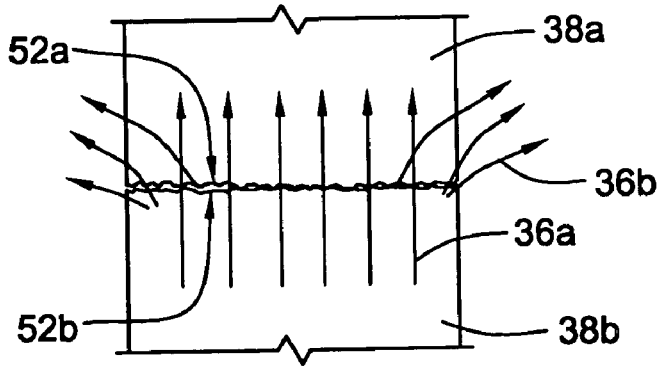
FIG. 7 is a cross-sectional view illustrating the transfer of magnetic energy from one annular core to another when the mating surfaces are irregular or rough.

Referring to FIG. 7, in another embodiment, no gap is present between the mating surfaces 52*a*, 52*b* of the cores 38*a*, 38*b*. Nevertheless, surface imperfections, even microscopic imperfections, may cause significant dispersion of magnetic energy 36*b*. This may also result in significant signal loss at the junction 52*a*, 52*b*. Thus, mere contact between the surfaces 52*a*, 52*b* may be insufficient.

Figure 8:
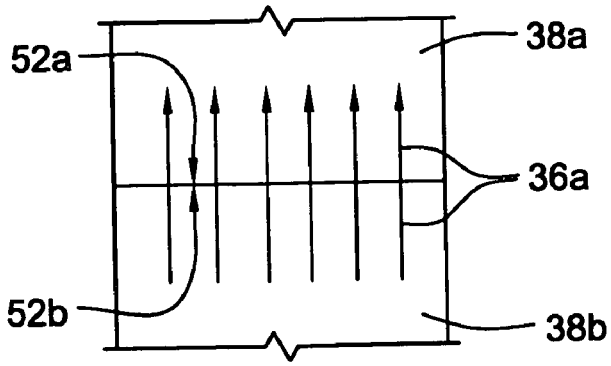
FIG. 8 is a cross-sectional view illustrating the transfer of magnetic energy from one annular core to another when the mating surfaces are planar and conformal.

Referring to FIG. 8, in another embodiment, the surfaces 52*a*, 52*b* may be polished or treated. In this embodiment, the junction 52*a*, 52*b* may closely resemble a continuous core and magnetic energy 36*a* may be efficiently coupled from one surface 52*a* to the other. Thus, the combination of surface contact and having surfaces 52*a*, 52*b* that are finely polished or treated may provide the most efficient coupling of energy.

Figure 9:
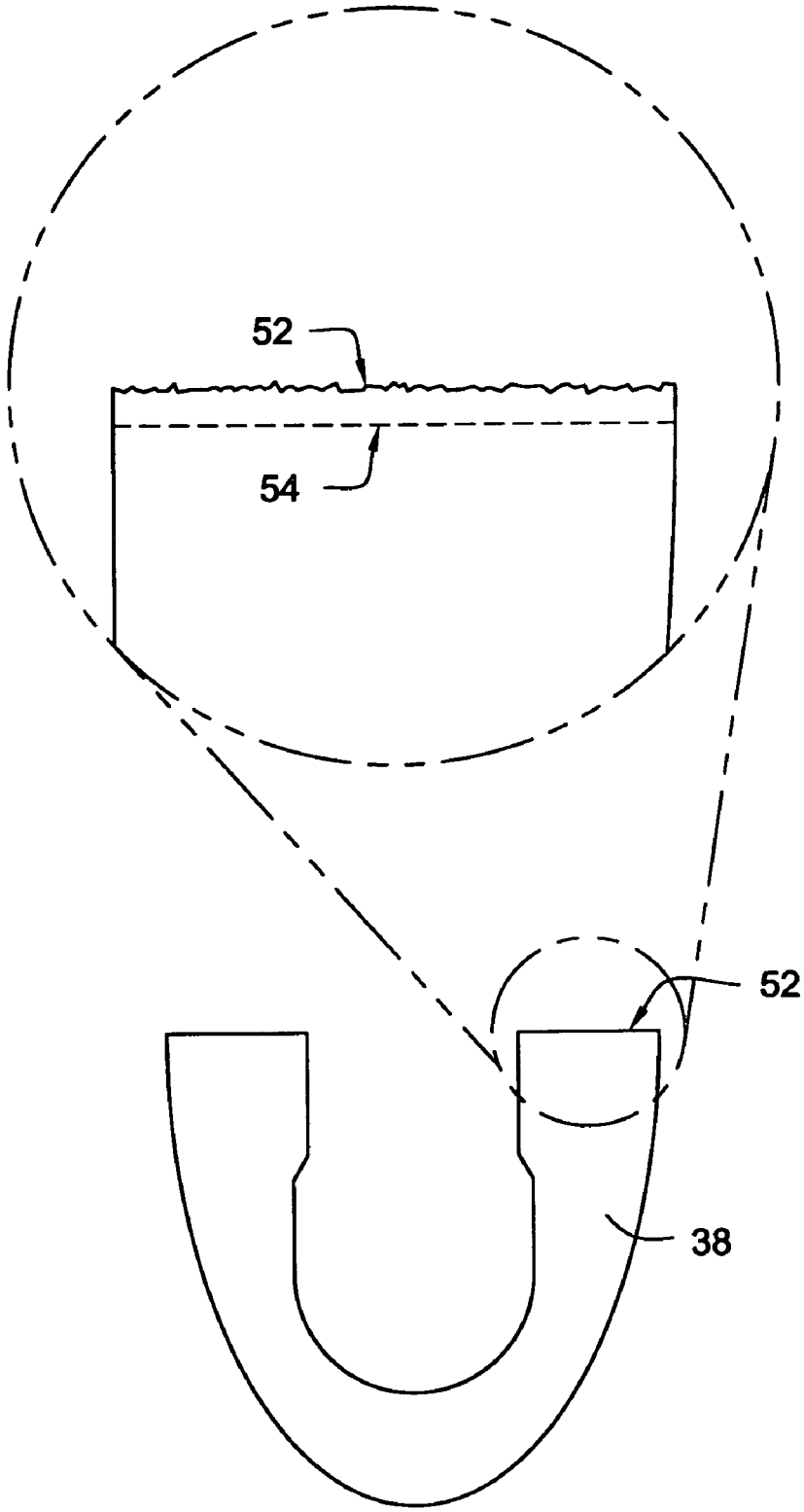
FIG. 9 is a cross-sectional view illustrating one embodiment of the mating surface of an annular core.

Referring to FIG. 9, in selected embodiments, a core 38 may be produced that may appear to have a uniform or smooth surface. However, upon magnification, the surface may exhibit significant irregularities and imperfections that may result in significant energy dispersion. Thus, a target surface 54 may be chosen and material may be removed from the surface until the target surface 54, having a desired finish, is reached. In selected embodiments, the core material 38 may be slightly oversize when manufactured, thereby permitting a selected layer of material to be removed to provide a desired finish.

Figure 10:
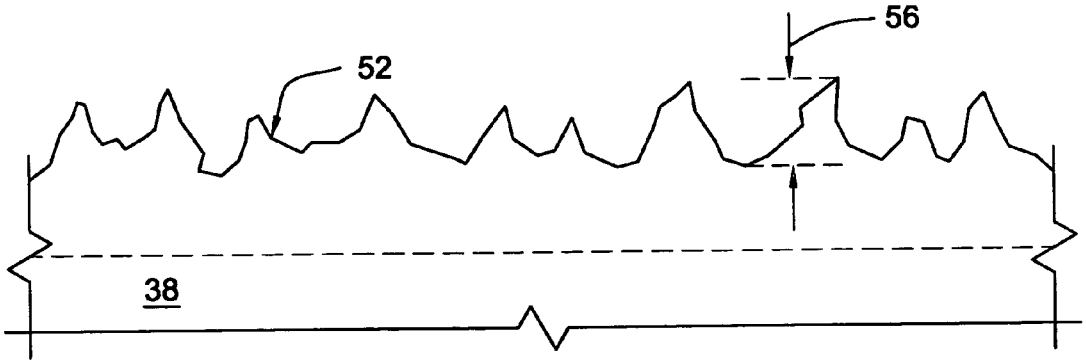
FIG. 10 is a cross-sectional view illustrating one embodiment of a rough untreated surface.

Referring to FIG. 10, a surface may be treated or finished in various stages to provide a desired finish. For example, initially, the surface 52*a* may be characterized by a roughness height 56*a*. Irregularities or peaks may be removed or smoothed using some course method of smoothing or material removal. For example, in selected embodiments, various methods of grinding may be used to remove significant surface 52*a* imperfections or irregularities. In selected embodiments, other techniques may be used to remove material, such as direct firing, wet etching, dry etching, or the like.

Figure 11:
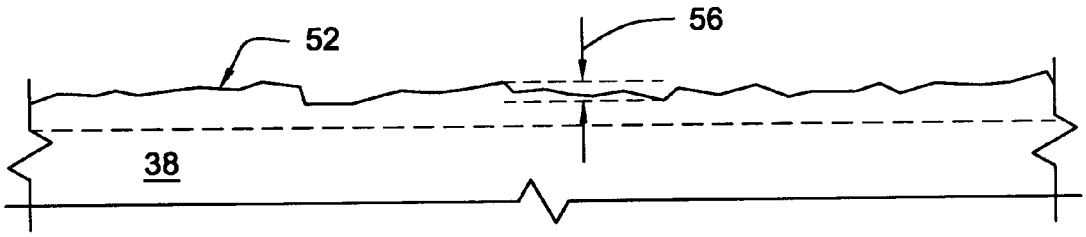
FIG. 11 is a cross-sectional view illustrating one embodiment of a partially smoothed or treated surface.
Figure 12:
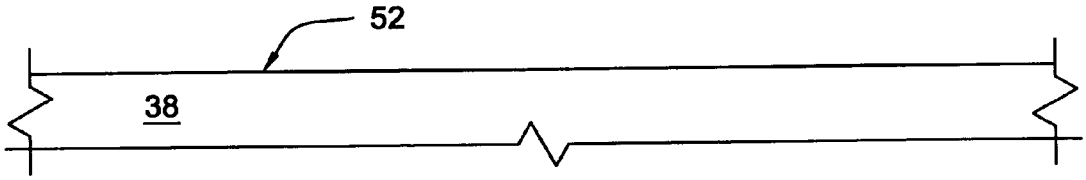
FIG. 12 is a cross-sectional view illustrating one embodiment of a fully smoothed or treated surface.

Referring to FIGS. 11 and 12, after a course method of material removal has been completed, the surface 52*b* may be characterized by a lesser roughness or irregularity height 56*b*. A finer method of smoothing or material removal may be used to finish this surface 52*b*. For example, the surface 52 may be lapped, hand polished, finely sanded, or the like to remove these slight irregularities. In addition, it is conceivable that a technique such as annealing, sintering, direct firing, etching, or the like, may be used to further smooth the surface to yield a desired finish 52*c*.

Figure 13:
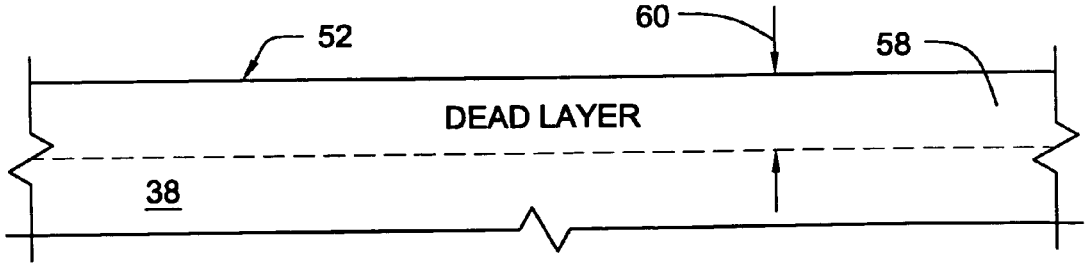
FIG. 13 is a cross-sectional view illustrating one embodiment of a dead layer that may exist in a smoothed or treated surface.

Referring to FIG. 13, smoothing the surface of the core 38 may provide various undesirable surface characteristics. For example, surface techniques, such as grinding, may leave dead layer 58 in the magnetic material. The layer 58 may not be completely "dead," but may have altered magnetic properties that may affect proper signal coupling between the cores 38. The "dead layer" may also exhibit undesired cracking or fractures. Thus, various techniques may be used to reduce the dead layer 58 or prevent occurrence of the dead layer 58. For example, in certain embodiments, successively finer and softer abrasives may be used to provide a desired surface finish and reduce the "dead layer" that may otherwise occur.

Figure 14:
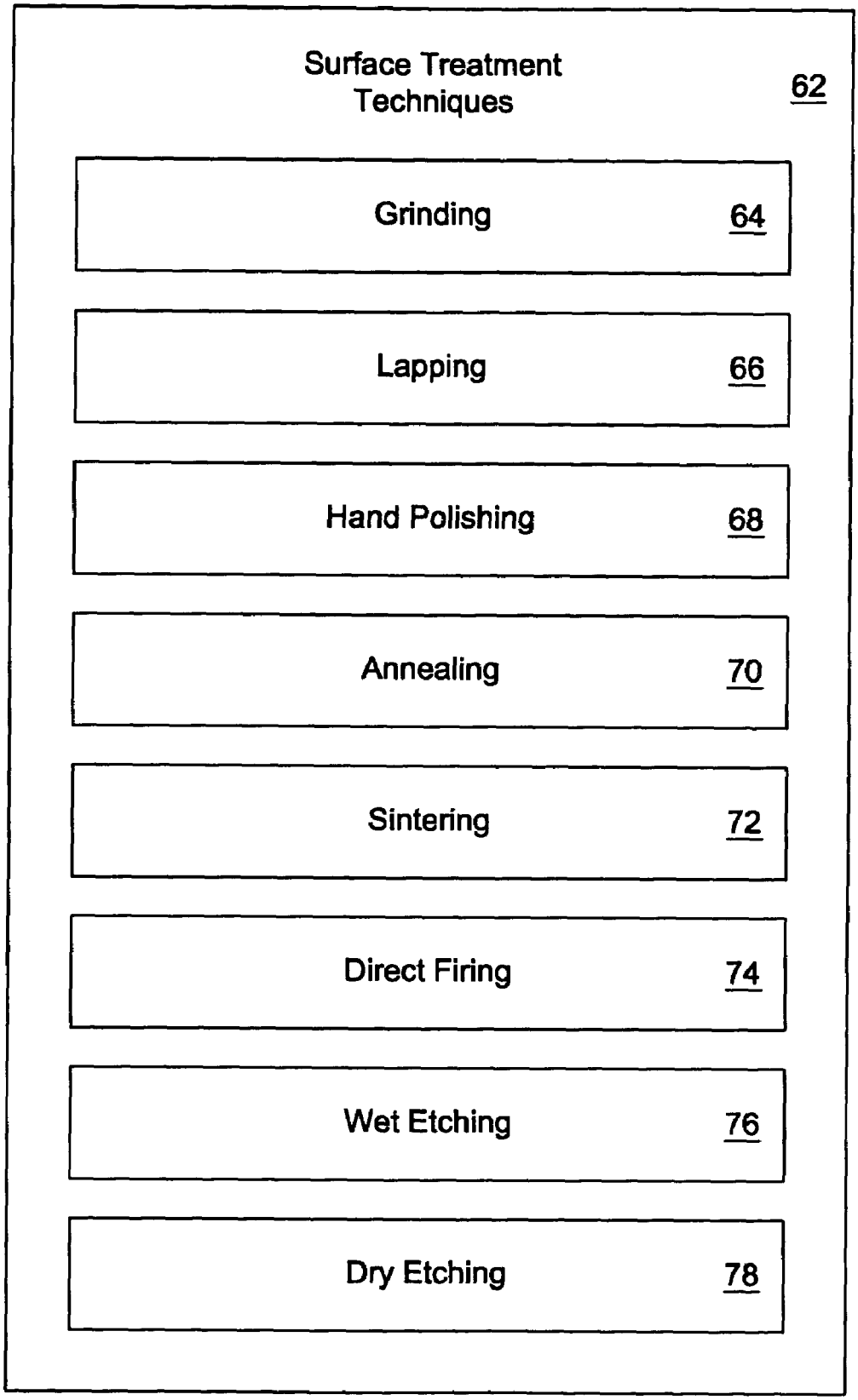
FIG. 14 is a schematic block diagram illustrating various surface smoothing and treating techniques.

Referring to FIG. 14, various surface treatment or smoothing techniques may be used alone or in combination to provide a desired finish to the core 38. For example, in selected embodiments, techniques may include grinding, lapping, hand polishing, annealing, sintering, direct firing, wet etching, dry etching, or other techniques. Selected techniques may be used to remove material, while others may be used to reduce or prevent a "dead layer" in the magnetic material.

The present invention may be embodied in other specific forms without departing from its essence or essential characteristics. The described embodiments are to be considered in all respects only as illustrative, and not restrictive. The scope of the invention is, therefore, indicated by the appended claims, rather than by the foregoing description. All changes within the meaning and range of equivalency of the claims are to be embraced within their scope.

What is claimed is:

1. A transmission element for transmitting information between downhole tools located on a drill string, the transmission element comprising:

an annular core constructed of a magnetically-conductive material, the annular core forming an open channel around the circumference thereof, the annular core further configured to mate with a corresponding annular core along an annular mating surface, thereby forming a closed channel;

an annular conductor disposed within the open channel; and the mating surface being further polished to provide improved magnetic coupling with the corresponding annular core.

2. The transmission element of claim 1, wherein the mating surface is polished by at least one method selected from the group consisting of grinding, lapping, hand polishing, annealing, sintering, direct firing, wet etching, and dry etching.

3. The transmission element of claim 2, wherein the mating surface is polished in multiple stages.

4. The transmission element of claim 2, wherein the mating surface is treated to minimize alteration of magnetic properties of the annular core.

5. The transmission element of claim 1, further comprising a biasing member configured to urge the annular core toward a corresponding annular core.

6. The transmission element of claim 5, wherein the biasing member is selected from the group consisting of a spring, an elastomeric material, an elastomeric-like material, a sponge, and a sponge-like material.

7. The transmission element of claim 1, wherein the annular core provides a low reluctance path for magnetic flux emanated from the annular conductor.

8. The transmission element of claim 1, wherein the mating surface is polished to reduce the dispersion of magnetic flux passing from one mating surface to another.

9. The transmission element of claim 1, wherein the magnetically conductive material is a ferrite.

10. The transmission element of claim 1, wherein the annular conductor comprises multiple coiled conductive strands.

11. The transmission element of claim 1, wherein the open channel has a substantially U-shaped cross-section.

12. A method for improving signal transmission between transmission elements transmitting information between downhole tools, the method comprising:

providing an annular core constructed of a magnetically conductive material, the annular core forming an open channel around the circumference thereof, the annular core further configured to mate with a corresponding annular core along an annular mating surface, in order to form a closed channel;

providing an annular conductor in the open channel; and polishing the mating surface to improve magnetic coupling with the corresponding annular core.

13. The method of claim 12, wherein polishing further comprises at least one technique selected from the group consisting of grinding, lapping, hand polishing, annealing, sintering, direct firing, wet etching, and dry etching.

14. The method of claim 13, wherein polishing further comprises polishing the mating surface in multiple stages.

15. The method of claim 13, further comprising treating the mating surface to minimize alteration of magnetic properties of the annular core.

16. The method of claim 12, further comprising urging the annular core toward a corresponding annular core.

17. The method of claim 16, wherein urging further comprises using a biasing member to urge the annular core toward a corresponding annular core, wherein the biasing member is selected from the group consisting of a spring, an elastomeric material, an elastomeric-like material, a sponge, and a sponge-like material.

18. The method of claim 12, wherein the annular core provides a low reluctance path for magnetic flux emanated from the annular conductor.

19. The method of claim 12, wherein polishing reduces the dispersion of magnetic flux passing from one mating surface to another.

20. The method of claim 12, wherein the magnetically conductive material is a ferrite.

* * * * *